US009663934B2

(12) United States Patent
Duncan

(10) Patent No.: US 9,663,934 B2
(45) Date of Patent: May 30, 2017

(54) FLOATING NIPPLE ASSEMBLIES FOR WAX FREE INSTALLATION OF NEW AND EXISTING TOILETS

(71) Applicant: Scott E Duncan, Santa Rosa, CA (US)

(72) Inventor: Scott E Duncan, Santa Rosa, CA (US)

( * ) Notice: Subject to any disclaimer, the term of this patent is extended or adjusted under 35 U.S.C. 154(b) by 246 days.

(21) Appl. No.: 14/210,043

(22) Filed: Mar. 13, 2014

(65) Prior Publication Data

US 2015/0322661 A1 Nov. 12, 2015

Related U.S. Application Data

(60) Provisional application No. 61/780,688, filed on Mar. 13, 2013.

(51) Int. Cl.
*E03D 11/16* (2006.01)

(52) U.S. Cl.
CPC ..... *E03D 11/16* (2013.01); *Y10T 29/49432* (2015.01)

(58) Field of Classification Search
CPC ..... E03D 11/16; E03D 11/00; E03D 11/02; E03D 11/13; E03D 5/012; Y10T 29/49423; F16J 15/10; F16J 15/102; F16J 15/104; F16J 15/106; F16J 15/02; F16J 15/021; F16J 15/022; F16J 15/06; F16J 15/061; F16J 15/0686
USPC ..... 403/288; 4/252.4, 252.5, 252.1
See application file for complete search history.

(56) References Cited

U.S. PATENT DOCUMENTS 4,515,398 A * 5/1985 Machon, Sr. ..... E03D 11/16 285/12
5,590,992 A * 1/1997 Russell ..... B60B 7/14 301/37.374
6,430,756 B1 * 8/2002 Reilly ..... E03D 11/16 4/252.1

* cited by examiner

*Primary Examiner* — David Bryant
*Assistant Examiner* — Lawrence Averick
(74) *Attorney, Agent, or Firm* — Steven A. Nielsen; www.NielsenPatents.com

(57) ABSTRACT

A new floating nipple assembly 200 comprises: a set of floating nipples 210 or threaded adapter sleeves, the floating nipples having inner voids and exteriors of outer male threads 214; a seal body 100 comprising ear assemblies 110 defining ear voids 220, the ear voids having inner female threads 222; closet bolts 230 inserted through a soil pipe flange 300, the closet bolts inserted through the ear voids 220, nipples 210 and a toilet base 410; and integrated cap nuts 500 placed over the toilet base 410 and frictionally attached to the ends of the closet bolts 230. Disclosed embodiments provide for wax free installation of toilets in either new construction or in retrofit projects. The floating nipple assemble system allows a plumber to effortlessly adjust the height of the seal body by merely rotating the floating nipples within the ear voids of the seal body.

6 Claims, 7 Drawing Sheets

FLOATING NIPPLE ASSEMBLIES FOR WAX FREE INSTALLATION OF NEW AND EXISTING TOILETS

CROSS-REFERENCE TO RELATED APPLICATIONS

This is a utility application based upon U.S. patent application Ser. No. 61/780,668 filed on Mar. 13, 2013. This related application is incorporated herein by reference and made a part of this application. If any conflict arises between the disclosure of the invention in this utility application and that in the related provisional application, the disclosure in this utility application shall govern. Moreover, the inventor(s) incorporate herein by reference any and all patents, patent applications, and other documents hard copy or electronic, cited or referred to in this application.

BACKGROUND OF THE INVENTION (1) Field of the Invention

The invention generally relates to wax free toilet installation systems. More particularly, the invention relates to wax free means and methods of attaching a soil pipe to a toilet in new construction or in a retro fit configuration.

(2) Related Art

Other wax free toilet installation systems and sleeve type configurations are known in the related art. But, the related art fails to provide a kit system providing a plumber means and methods of applying an adjustable height wax free system in either new construction and for a retro fit application using a single threaded adapter sleeve.

The prior art fails to disclose, anticipate or suggest the use of lower seals to stop the flow of sewer gasses. For example, U.S. Pat. Nos. 1,335,056 and 1,594,350 would not be code compliant in modern construction, as the two patents fail to provide for, inter alia, sewer gas stoppage as now required in all current building codes.

The prior art also fails to teach, disclose or suggest a new closet flange system or male female pipe coupler for new home construction that integrates with the disclosed threaded adapter sleeve.

BRIEF SUMMARY OF THE INVENTION

The present invention overcomes shortfalls in the related art by presenting an unobvious and unique combination and configuration of sleeves, threads, mechanical attachments, adjustment nuts, threaded adapter sleeves, male female pipe couplers, and other components to artfully attach a toilet to a prior art closet flange for a retro fit application and to install a new male female pipe coupler to a soil pipe in new home construction.

The present invention overcomes shortfalls in the prior art by presenting a kit system that enables a plumber to retro fit an older wax seal system with the disclosed wax free system while using an existing prior art closet flange. In the prior art, converting a prior art closet flange to a wax free system required the use of many parts and intensive labor. The present invention integrates several prior art components into a few multi-function components that provide lower labor and part costs. The new multi-function components include a new threaded adapter sleeve or floating nipple that works with both prior art closet flanges and the disclosed male female pipe coupler.

In a retro fit application, a plumber is presented with an existing prior art closet flange that is either three inches or four inches in diameter. With the present invention, a plumber may remove an old wax seal system and insert the disclosed threaded adapter sleeve into the existing three inch or four inch prior art closet flange.

The disclosed threaded adapter sleeve or floating nipple comes with various adjustment nuts and seals to quickly adjust the mounting face of the threaded adapter sleeve to the correct height. Since the disclosed threaded adapter sleeve works with both three inch and four inch prior art closet flanges, less parts need to be stocked by a plumber. The disclosed threaded adapter sleeve provides for quick and nondestructive height adjustments that are often needed in bathroom remodeling projects where finished floor heights are often subject to a home owner's fluid design choices.

For new construction, the same threaded adapter sleeve seamlessly integrates into the disclosed male female pipe coupler. When a plumber is called to a job site, the plumber does not know if a three inch or four inch soil pipe will be found. In the prior art, a plumber would need to stock and carry both three inch and four inch closet flanges. The present invention overcomes this shortfall in the art by disclosure of a new male female pipe coupler that works with both three inch and four inch soil pipes.

The disclosed male female pipe coupler works with the disclosed threaded adapter sleeve and provides advantages over the prior art closet flanges. The disclosed male female pipe coupler includes various advantages over the prior art closet flanges.

In a disclosed embodiment, a disclosed system or kit includes a soil pipe, washer, seal body, treated female standups having ears, female threads in the ears, closet bolts accepting floating nipple nuts or units in a system to attach a new or old toilet base or system. An optional integrated cap nut is secured over a toilet base. In a disclosed embodiment, a new floating nipple assembly provides seamless height adjustment of sea bodies and reduces the number of needed tools and components in water closet installation.

These and other objects and advantages will be made apparent when considering the following detailed specification when taken in conjunction with the drawings.

REFERENCE NUMERALS IN THE DRAWINGS

Figure 1:
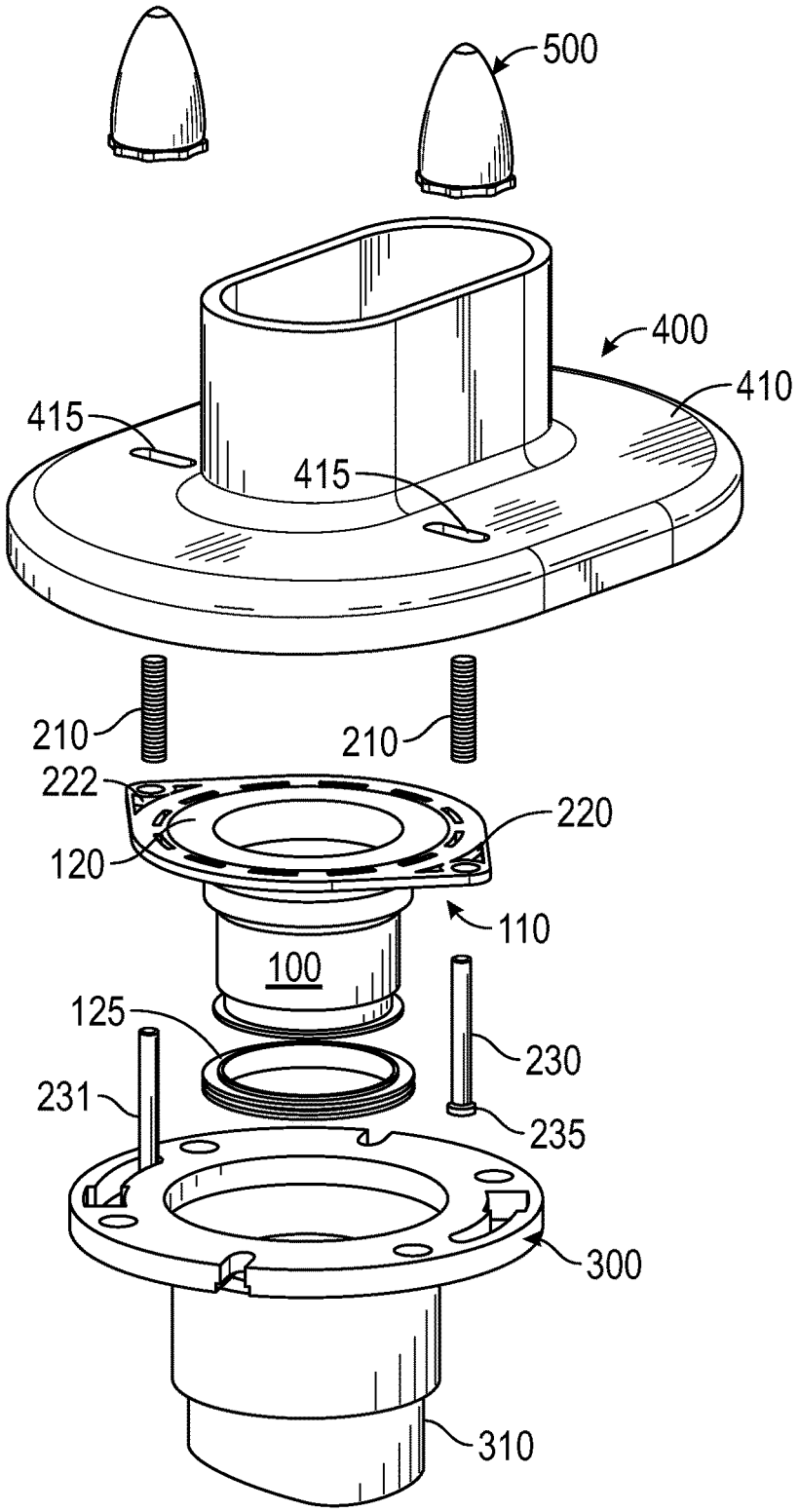
FIG. 1 depicts perspective view of a disassembled embodiment

100 seal body
101 upper section of seal body
105 inferior section or lower section of seal body 100
110 ear assembly of superior end of seal body
120 seal placed on or near ear assembly
125 inferior seal or gasket of inferior side of seal body 100
200 floating nipple assembly
210 floating nipple
212 inner void within floating nipples 210
214 outer male threads of floating nipples 210
220 ear void
222 inner female threads of ear void 220
230 closet bolt
231 closet bolt positioned within a soil pipe flange
232 closet bolt positioned within soil pipe flange and within floating nipple 210
235 lower stopper section of closet bolt
300 soil pipe flange
302 closet bolt voids
310 soil pipe
400 toilet assembly
410 toilet base
415 bolt voids defined within the toilet base 410
420 horn of toilet assembly
500 integrated cap nuts
510 inner threaded void area of integrated cap nuts

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

Any and all the above references and U.S. patents and applications are incorporated herein by reference. Aspects of the invention can be modified, if necessary, to employ the systems, functions and concepts of the various patents and applications described above to provide yet further embodiments of the invention.

These and other changes can be made to the invention in light of the above detailed description. In general, the terms used in the following claims, should not be construed to limit the invention to the specific embodiments disclosed in the specification, unless the above detailed description explicitly defines such terms.

A new floating nipple assembly 200 comprises a set of floating nipples 210, with the floating nipples having inner voids 212 and outer male threads 214, ear voids 220 with the ear voids having inner female threads 222 and closet bolts 230. Floating nipples 210 used with the threaded ear voids and closet bolts provide a new system of efficiently securing a toilet assembly to a soil pipe or other base structure. The disclosed threading of the components of the floating nipple assembly 200 vitiates the prior art shortfall of making height adjustments by the cutting of closet bolts. In the prior art, closet bolts would need to be cut so as not to overly protrude over a toilet assembly. The disclosed floating nipple assembly 200 and other disclosed components reduce the time and effort in toilet installation and allow for easy height adjustments of a seal body to comport with either new or existing water closet construction.

FIG. 1 depicts a disclosed embodiment comprising a seal body 100, ear assembly 110 of the superior or upper end of seal body 100, a seal 120 placed on or near the ear assembly, inferior seal or gasket 125 placed or found upon the inferior or lower side of the seal body 100.

A closet bolt 231 is positioned within the soil pipe flange 300. A clearer view of a closet bolt 230 is shown unattached to the soil pipe flange 300. The nipples 210 have outer threads complementary to the inner threads 222 of the ear voids 220.

Upon assembly, the closet bolts 231 may be positioned within the soil pipe flange 300, the floating nipples 210 may be rotationally attached or screwed into the ear voids 220, and the closet bolts may be inserted though the interior voids of the floating nipples. The closet bolts and floating nipples pass though the bolt voids 415 defined within the toilet base. The integrated cap nuts 500 have inner threaded void areas 510 that may be rotationally fastened or screwed down upon the protruding closet bolts. As the floating nipples are screwed, the seal body and other components self-adjust to the correct elevations to create a wax free seal or installation of the toilet.

Figure 2:
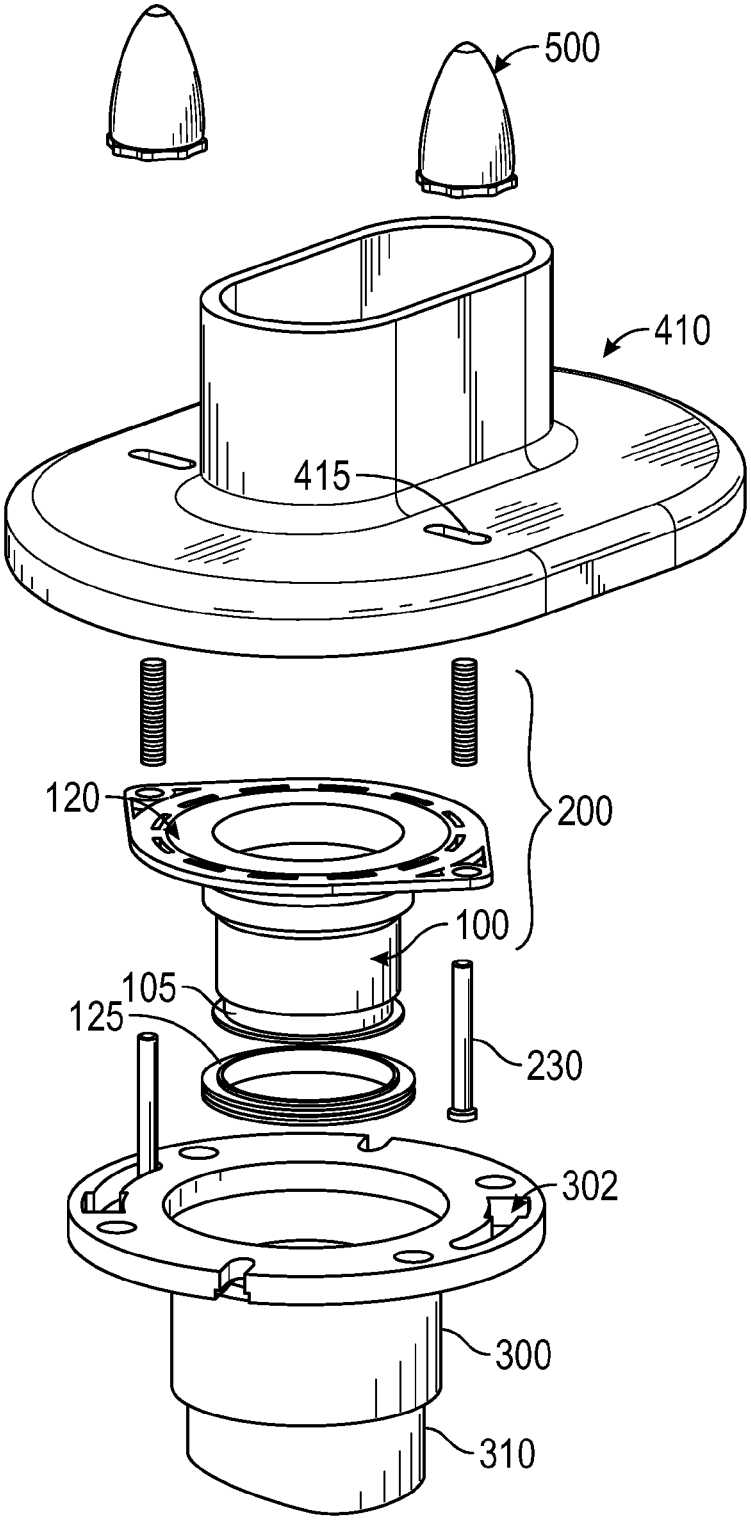
FIG. 2 depicts perspective view of a disassembled embodiment

FIG. 2 depicts components of the floating nipple assembly 200, as well as a soil pipe 300 and integrated cap nuts 500. A disclosed floating nipple assembly may be considered to comprise: closet bolts, a seal body 100, ear assemblies, floating nipples 210 and integrated cap nuts 500.

The disclosed soil pipe flange 300 will comport with either 3 inch or 4 inch soil pipes. In FIG. 2, a soil pipe 310 is shown to fit within the inside of the soil pipe flange. The soil pipe flange has closet bolt voids 302. In a disclosed embodiment, the 100 seal body may be flexible and upwardly urge or provide an upward bias to apply pressure upon the toilet base 410 and/or a horn of the toilet assembly.

Figure 3:
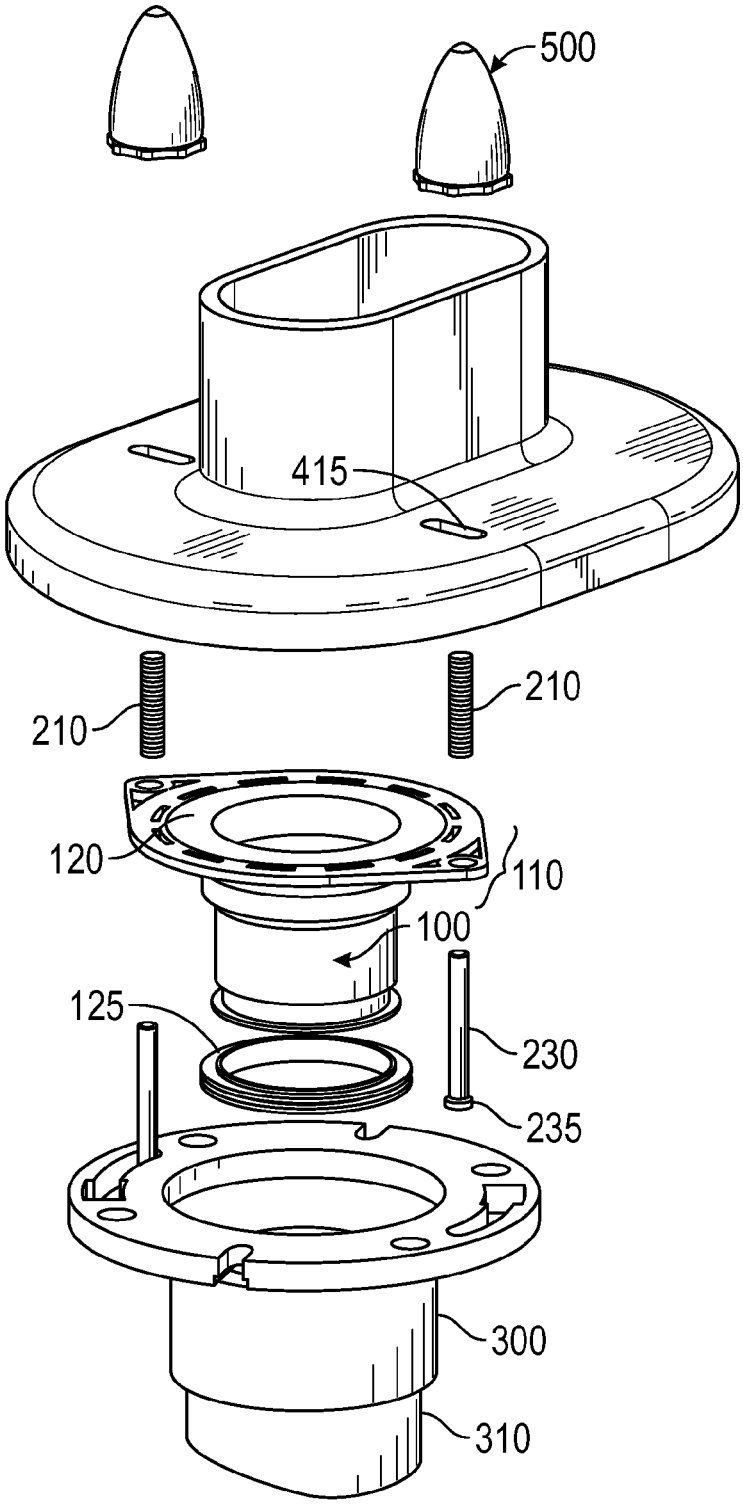
FIG. 3 depicts perspective view of a disassembled embodiment

FIG. 3 depicts disclosed components in a disassembled state.

Figure 4:
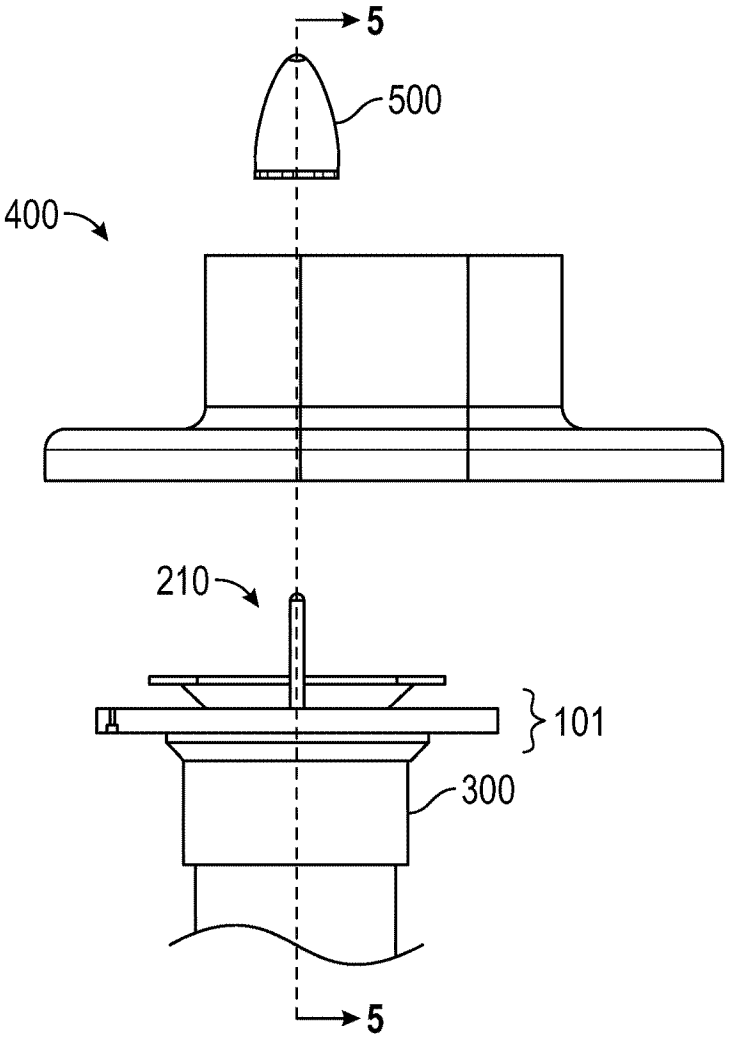
FIG. 4 depicts an elevation view of disclosed components

FIG. 4 depicts an elevation view of a cap nut 500 and other components. A cap nut may be comprised of inner threaded void area 510 so as to accept a closet bolt. FIG. 4 depicts a floating nipple 210 inserted though the top portion 101 of the seal body and in position for further insertion though the toilet assembly.

Figure 5:
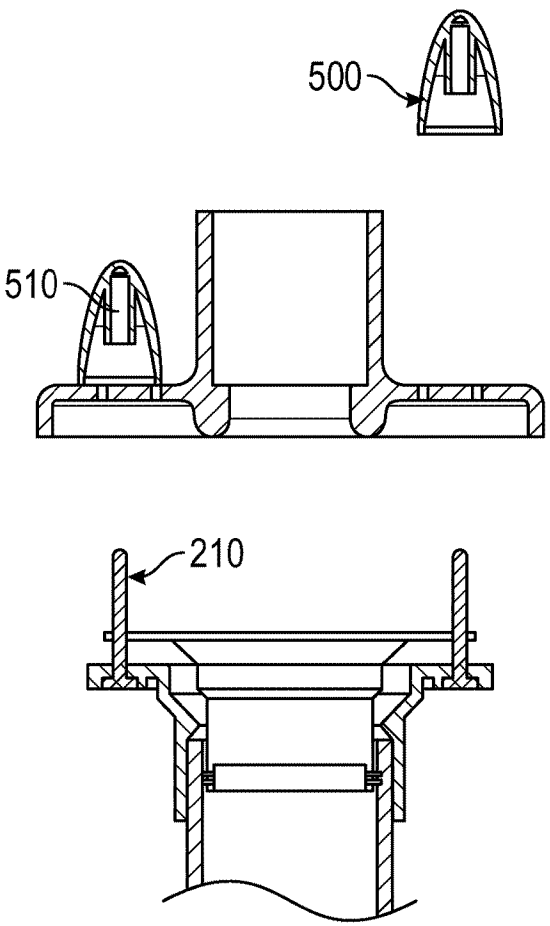
FIG. 5 depicts a sectional view of FIG. 4

FIG. 5 depicts a sectional view of FIG. 4 and depicts an inner threaded void area 510 of an integrated cap nut.

Figure 6:
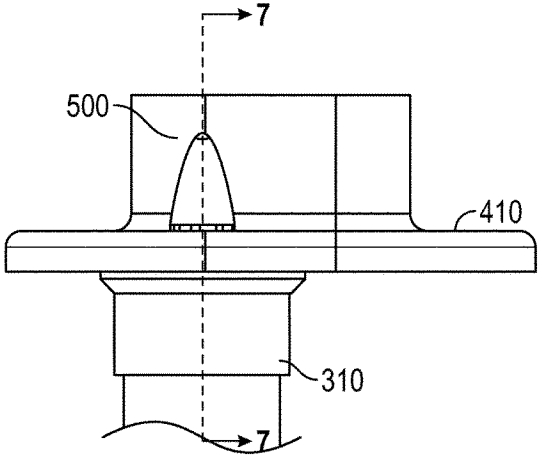
FIG. 6 depicts disclosed components in an assembled condition

FIG. 6 depicts an integrated cap nut frictionally attached to a toilet base 410.

Figure 7:
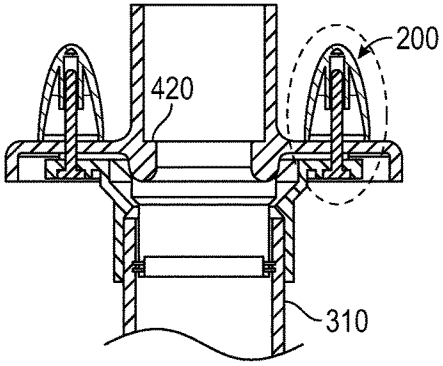
FIG. 7 depicts a sectional view of FIG. 6

FIG. 7 depicts a sectional view of FIG. 6 and depicts various components of a disclosed floating nipple assembly 200. A sectional view of a toilet horn 420 is shown as secured within the seal body and soil flange pipe.

Figure 8:
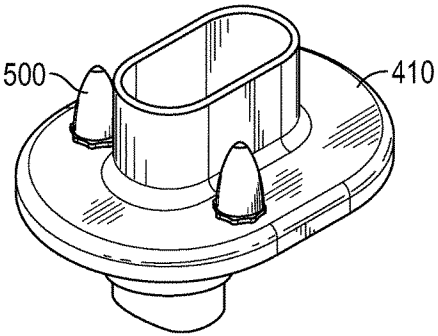
FIG. 8 depicts a perspective view of disclosed components in an assembled condition

FIG. 8 depicts a perspective view of a disclosed embodiment.

Figure 10:
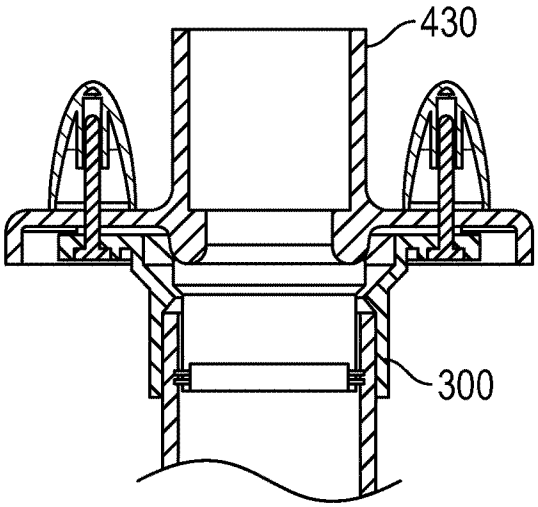
FIG. 10 depicts a sectional view of FIG. 9
Figure 11:
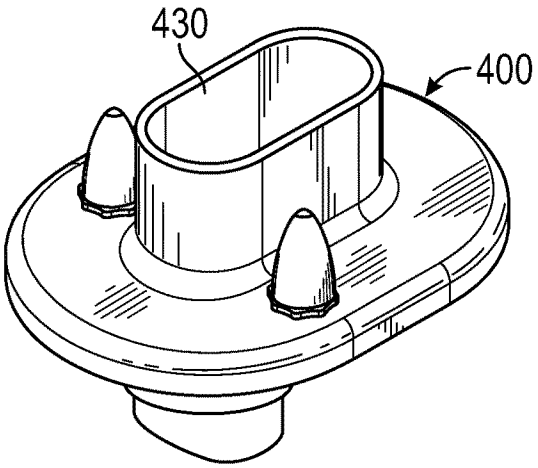
FIG. 11 depicts a perspective view of disclosed components in an assembled condition
Figure 9:
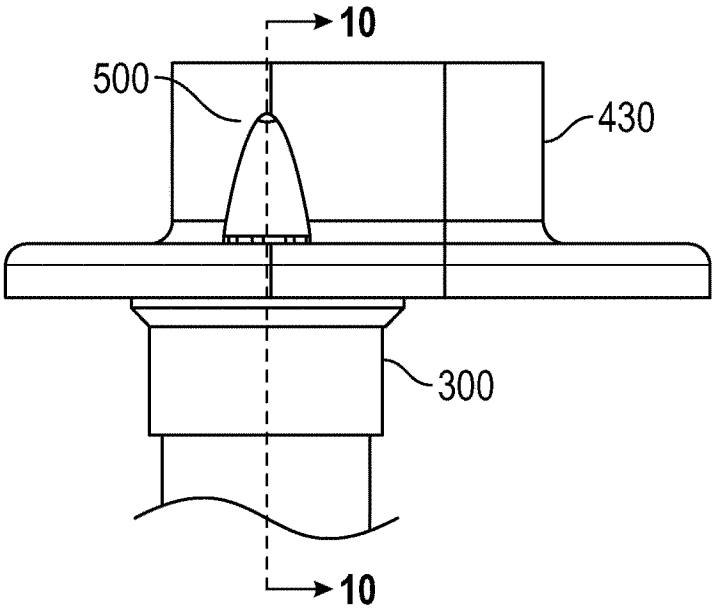
FIG. 9 depicts disclosed components in an assembled condition

FIGS. 9, 10 and 11 depict a neck section 430 of a typical toilet. The neck section may lead to the lower section of a toilet.

Figure 13:
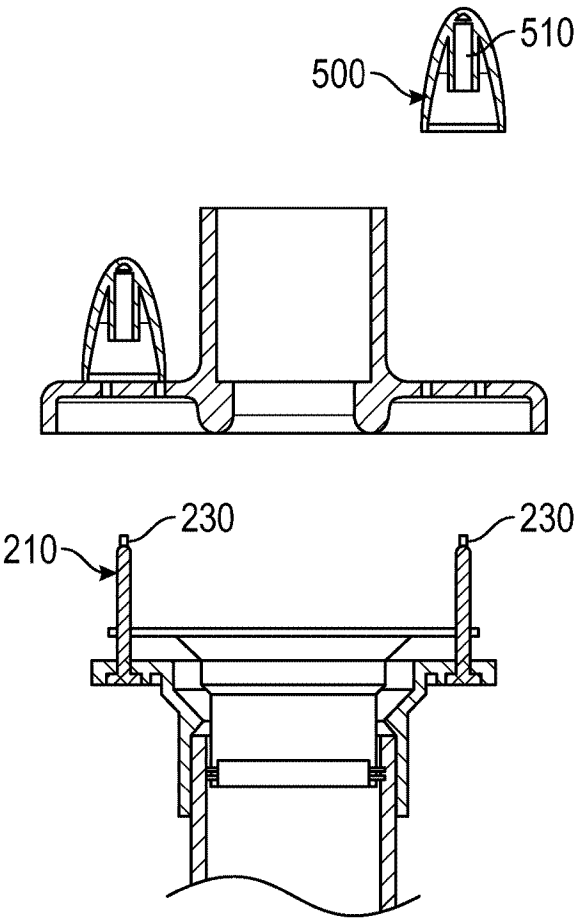
FIG. 13 depicts a sectional view of FIG. 12
Figure 12:
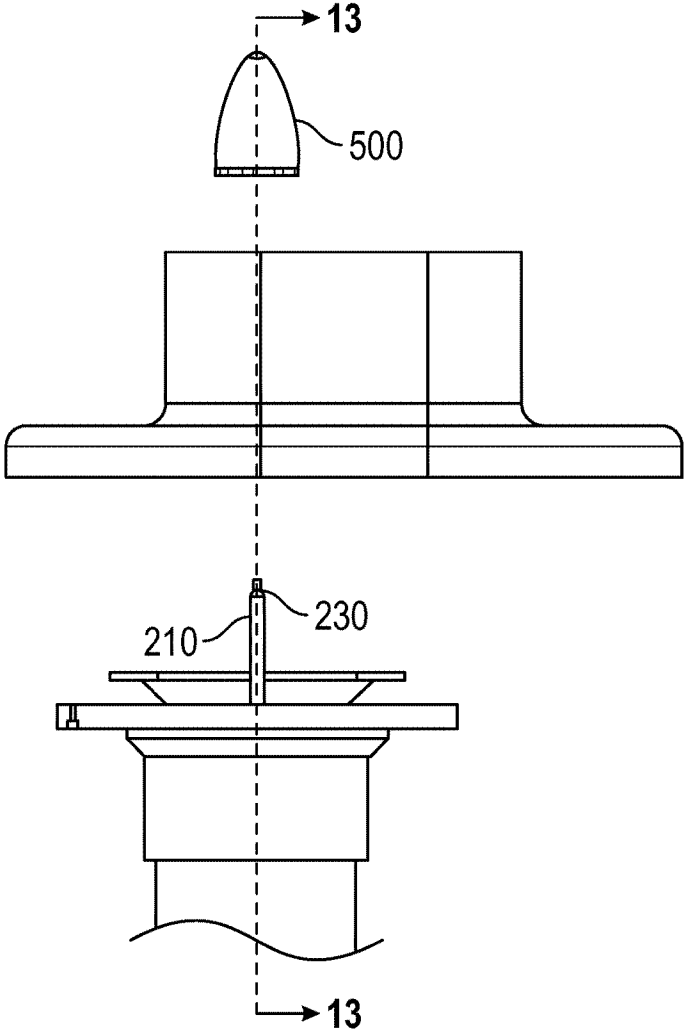
FIG. 12 depicts an elevation view of disclosed components in a dissembled condition.

FIGS. 12 and 13 depict closet bolts 230 extending slightly beyond the top portions of the floating nipples. The integrated nut caps 500 are fastened to the closet bolts.

Items

Disclosed embodiments may include, but are not limited to the disclosed items below. The definitions or descriptions within this specification do not limit the scope of the claims.

Item 1. A system for wax free installation of a toilet, the system comprising:

one or more closet bolts 230 the closet bolts comprised of a longitudinal void;

one or more floating nipples 210, the floating nipples comprising a longitudinal void and outer threads 214;

a seal body 100 comprising one or more ear assemblies 110 disposed upon an upper section of the seal body, each ear assembly defining an ear void 220, the perimeter of each ear void comprising threads; and one or more integrated nut caps 500, each nut cap comprising an inner threaded void area 510.

Item 2. The system of item 1 wherein the floating nipples comprise outer male threads and the perimeter of each ear void comprises female threads.

Item 3. The system of item 1 wherein each closet bolt further comprises a lower stopper section 235.

Item 4. The system of item 1 further comprising an inferior seal 125 frictionally attached to an inferior section 105 of the seal body.

Item 5. The system of item 1 further comprising a seal 120 disposed upon the seal body.

Item 6. The system of item 1 wherein the seal body comprises flexible material generating an upward bias upon compression.

Item 7. The system of item 1 further comprising a soil pipe flange 300, the soil pipe flange defining one or more closet bolt voids 302.

Item 8. A kit for wax free installation of a toilet, the kit comprising:

one or more closet bolts 230 the closet bolts comprised of a longitudinal void;

one or more floating nipples 210, the floating nipples comprising a longitudinal void and outer threads 214;

a seal body 100 comprising one or more ear assemblies 110 disposed upon an upper section of the seal body, each ear assembly defining an ear void 220, the perimeter of each ear void comprising threads; and one or more integrated nut caps 500, each nut cap comprising an inner threaded void area 510.

Item 9. The kit of item 8 wherein the floating nipples comprise outer male threads and the perimeter of each ear void comprises female threads.

Item 10. The kit of item 8 wherein each closet bolt further comprises a lower stopper section 235.

Item 11. The kit of item 9 further comprising a soil pipe flange.

Item 12. The kit of item 11 wherein the soil pipe flange defines one or more closet bolt voids.

Item 13. A method of installing a toilet without the use of wax, the method comprising the steps of:

using one or more closet bolts frictionally attached to a soil pipe flange;

rotationally attaching one or more floating nipples into an ear void, the ear void defined within an ear assembly of a seal body;

inserting each closet bolt through each floating nipple;

inserting each floating nipple through a bolt void, the bolt void defined within a toilet base; and frictionally attaching an integrated cap nut upon each closet bolt.

Item 14. The method of item 13 using floating nipples with outer male threads and using ear voids with female threads.

Item 15. The method of item 13 including the step of adjusting the height of the seal body by rotating each floating nipple.

What is claimed is:

1. A system for wax free installation of a toilet and for height adjustment of a seal body by use of floating nipples, the system comprising:

one or more closet bolts the closet bolts comprised of a lower stopper;

one or more floating nipples, the floating nipples comprising a longitudinal void and outer threads;

the seal body comprising one or more ear assemblies disposed upon an upper section of the seal body, each ear assembly defining an ear void, the perimeter of each ear void comprising inner threads; and one or more integrated nut caps, each nut cap comprising an inner threaded void area, the closet bolts disposed within closet bolt voids, the closet bolt voids defined within a soil pipe flange with the closet bolt lower stoppers disposed upon a bottom side of the soil pipe flange;

the closet bolts inserted through the longitudinal voids of the floating nipples, wherein the floating nipples are positioned above the soil pipe flange;

wherein the floating nipples are screwed into the ear voids to adjust the vertical distance between the soil pipe flange and the seal body;

the closet bolts extending slightly beyond top portions of the floating nipples and the closet bolts disposed within bolt voids defined within a toilet base;

the closet bolts having top ends secured within inner threaded void areas defined within the integrated nut caps.

2. The system of claim 1 further comprising a seal frictionally attached to a lower section of the seal body.

3. The system of claim 1 wherein the seal body comprises flexible material generating an upward bias upon compression.

4. A kit for wax free installation of a toilet and for height adjustment of a seal body by use of floating nipples, the kit comprising:

one or more closet bolts the closet bolts comprised of a lower stopper;

one or more floating nipples, the floating nipples comprising a longitudinal void and outer threads;

the seal body comprising one or more ear assemblies disposed upon an upper section of the seal body, each ear assembly defining an ear void, the perimeter of each ear void comprising threads; and one or more integrated nut caps, each nut cap comprising an inner threaded void area;

the closet bolts configured to be within closet bolt voids, the closet bolt voids defined within a soil pipe flange, with the closet bolt lower stoppers of the closet bolts disposed upon a bottom side of a soil pipe flange;

the closet bolts configured to be inserted through the longitudinal voids of the floating nipples, wherein the floating nipples are configured to be screwed into the ear voids to adjust the height between the soil pipe flange and the seal body;

the closet bolts configured to extend slightly beyond top portions of the floating nipples and the closet bolts configured to be disposed within bolt voids, the bolt voids defined within a toilet base;

the closet bolts comprising top ends comporting to inner threaded void areas defined within the integrated nut caps.

5. A method of installing a toilet without the use of wax, and for adjusting the height of a seal body by use of a plurality floating nipples, the method comprising the steps of:

using one or more closet bolts frictionally attached to a soil pipe flange;

threading each of the plurality of floating nipples into a corresponding ear void, each ear void defined within an ear assembly of a seal body, and each ear void comprising threads;

inserting each closet bolt through each floating nipple;

inserting each floating nipple through a bolt void, the bold void defined within a toilet base; and frictionally attaching an integrated cap nut upon each closet bolt;

adjusting the height of the seal body by rotating the floating nipples.

6. The method of claim 5 using floating nipples with outer male threads and using ear voids with female threads.

* * * * *